US008939526B1

(12) United States Patent
Chambers et al.

(10) Patent No.: US 8,939,526 B1
(45) Date of Patent: Jan. 27, 2015

(54) ADJUSTABLE FACE PANEL MOUNTING ASSEMBLY

(71) Applicant: Rev-A-Shelf Company, LLC, Jeffersontown, KY (US)

(72) Inventors: Paul F. Chambers, Louisville, KY (US); Kevin M. Ward, Jr., Louisville, KY (US); David P. Noe, Louisville, KY (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 0 days.

(21) Appl. No.: 14/141,854

(22) Filed: Dec. 27, 2013

(51) Int. Cl.
*A47B 88/00* (2006.01)

(52) U.S. Cl.
USPC ..... 312/348.4

(58) Field of Classification Search
USPC ..... 312/263, 330.1, 334.1, 334.4, 334.7, 312/348.1, 348.2, 348.4
See application file for complete search history.

(56) References Cited

U.S. PATENT DOCUMENTS

| | | | | |
|---|---|---|---|---|
| 2,934,390 | A | 4/1960 | Wright | |
| 4,090,753 | A * | 5/1978 | Rock et al. | 312/140 |
| 4,173,380 | A | 11/1979 | Diipree | |
| 4,579,402 | A | 4/1986 | Wenzlick et al. | |
| 4,902,080 | A * | 2/1990 | Berger | 312/348.4 |
| 5,002,346 | A * | 3/1991 | Gasser | 312/348.4 |
| 5,634,702 | A | 6/1997 | Fistonich | |
| 5,733,026 | A | 3/1998 | Munachen | |
| 5,938,305 | A * | 8/1999 | Rubsam-Tomlinson | 312/270.1 |
| 6,007,172 | A | 12/1999 | Shufelt et al. | |
| 6,099,099 | A | 8/2000 | Shufelt et al. | |
| 6,189,307 | B1 * | 2/2001 | Buss et al. | 56/320.1 |
| 6,390,576 | B1 * | 5/2002 | Walburn | 312/348.4 |
| 6,561,605 | B1 * | 5/2003 | Akers | 312/348.1 |
| 7,204,569 | B2 | 4/2007 | Walburn | |
| D596,424 | S | 7/2009 | Noe et al. | |
| 8,002,366 | B2 * | 8/2011 | Fitz | 312/348.4 |
| 8,047,621 | B2 | 11/2011 | Walburn | |
| 8,091,971 | B2 | 1/2012 | Ward et al. | |
| 8,297,724 | B2 * | 10/2012 | Hammerle | 312/348.4 |
| 8,388,076 | B2 | 3/2013 | Walburn | |
| 2007/0024166 | A1 | 2/2007 | Sung | |

* cited by examiner

*Primary Examiner* — Matthew Ing
(74) *Attorney, Agent, or Firm* — Brinks Gilons & Lione

(57) ABSTRACT

A face panel mounting assembly provides for adjustable mounting of a drawer face panel to a drawer slide mechanism. The assembly includes a plate adapted to be vertically adjustably fixed to a back surface of a drawer face panel, an angled bracket secured to the drawer slide mechanism having a first leg and a second leg, and fasteners passing rearwardly through the plate and bracket to horizontally adjustably secure the drawer face panel to the drawer slide mechanism at a desired position. The assembly also includes anchor plate fixed to the front end of each movable drawer slide rail that includes an opening defining a pivot axis for tilting movement of the drawer face panel and an opening defining a range of movement of the drawer face panel about the pivot axis.

20 Claims, 6 Drawing Sheets

ADJUSTABLE FACE PANEL MOUNTING ASSEMBLY

CROSS-REFERENCE TO RELATED APPLICATION

The present application is being filed concurrently with our application entitled CABINET DRAWER FLOOR AND FENCE ASSEMBLY, which is hereby incorporated by reference in its entirety.

BACKGROUND

1. Technical Field

The present disclosure relates to drawers with face panels mounted to move with the drawers, and more particularly relates to assemblies mounting the face panels to the drawer slides.

2. Background Information

Most drawers typically consist of a bottom surrounded by four upright members defining a back wall, two side walls, and a drawer front. The contents of the drawer can be accessed through an open horizontal plane defined generally by the upper margins of the back wall and two side walls. To facilitate such access, a drawer slide can be coupled to each side of the drawer and to each side of the drawer receiving opening in the cabinet holding the drawer. Each drawer slide consists generally of a first rail that is designed to be fixed to the side of the drawer and a second rail that is designed to be fixed to the cabinet. The first and second rails are coupled to each other by inter-engaging surfaces such a glides or bearings that facilitate relative movement between the two rails. A wide variety of such drawer slides exist that are suitable for use to permit drawers to move smoothly and easily in and out of cabinetry, particularly cabinetry typically found in kitchens.

Some drawers have a different construction from that previously described. In particular, some drawers, for example drawers typically situated in under-counter cabinets that include one or more waste containers. An example is to be found in Ward et al. U.S. Pat. No. 8,091,971, the entirety of which is hereby incorporated by reference. The drawer consists of a bottom designed to support the waste containers, and may include a back wall, and side walls for maintaining the waste container in an upright position. To facilitate access, drawer slides can be coupled to an under structure supporting the drawer bottom and to the bottom of the drawer receiving opening in the cabinet holding the drawer. A soft-close mechanism can be included in the understructure supporting the drawer bottom. A drawer front wall may be provided that includes provisions for interchangeably mounting a decorative face panel designed to match any adjacent cabinetry. Desirably the mounting is designed to adjustably mount the face panel to the drawer so that when the drawer is closed, the drawer face panel is in flush contact with the front surface of the cabinet enclosure and into desired height, pitch, roll, lateral and skew positions with respect to the front surface of the enclosure.

More recently, there has been a desire to provide such drawers that are lighter so that they can be move inward and outward with greater ease. There has also been a desire to provide such drawers that are more easily cleaned to ensure good hygiene in food preparation areas and other situations where such built in waste disposal drawer systems are employed. There has been a desire to mold portions of such drawers from anti-bacterial polymers.

BRIEF SUMMARY

A face panel mounting assembly provides for adjustable mounting of a drawer face panel to a drawer slide mechanism. The assembly can include a plate adapted to be fixed to a back surface of a drawer face panel, an angled bracket having a first leg and a second leg, and fasteners passing through the plate and bracket to adjustably secure the drawer face panel to the drawer slide mechanism at a desired position.

In one embodiment, the plate can include a pair of vertically spaced horizontal slots and a plurality of openings adapted to receive fasteners for securing the plate to a back surface of a drawer face panel. The first leg can include a plurality of openings to receive fasteners for securing the first leg to a drawer slide mechanism. The second leg can include a laterally extending flange. The flange can include a pair of openings spaced apart by a distance equal to the spacing of the vertically spaced horizontal slots. The fasteners can pass through the pair of openings in the flange of the angled bracket second leg and through the vertically spaced horizontal slots of the plate to adjustably secure the drawer face panel to the drawer slide mechanism at a desired position.

In one embodiment, the plate can be formed to include a first portion including a planar surface adapted to abut the back surface of the drawer face panel, and a second portion having a surface recessed from the first portion planar surface, the first and second portions being joined to each other by steps. The vertically spaced horizontal slots can be confined to the second portion of the plate having the recessed surface. The plate can include an outside vertical edge, and when the plate is fixed to the drawer face panel, the outside edge can be aligned with a lateral outside edge of the drawer face panel.

In one embodiment, the fasteners can include a head and a stem portion extending perpendicularly from the head, the stem portion including a threaded portion for engaging a nut, and the stem portion including a pair of parallel surfaces spaced from each other by a distance approximating the width of each of the vertically spaced horizontal slots. A fastener of this nature resists turning in the slot so that a nut can be applied to the stem without holding the head. The fasteners can include a head having a selected thickness and the surface of the second portion of the plate can be recessed from the first portion of the plate by a distance that at least matches the selected thickness of the head of the fasteners so that the head need not contact the adjacent back surface of the drawer face panel when the plate is attached to the face panel back surface.

These and other features and advantages of the present invention will become apparent to those skilled in the art from the following description of a preferred embodiment of the present invention that is illustrated in the accompanying drawings.

DETAILED DESCRIPTION OF THE PREFERRED EMBODIMENTS

Figure 1:
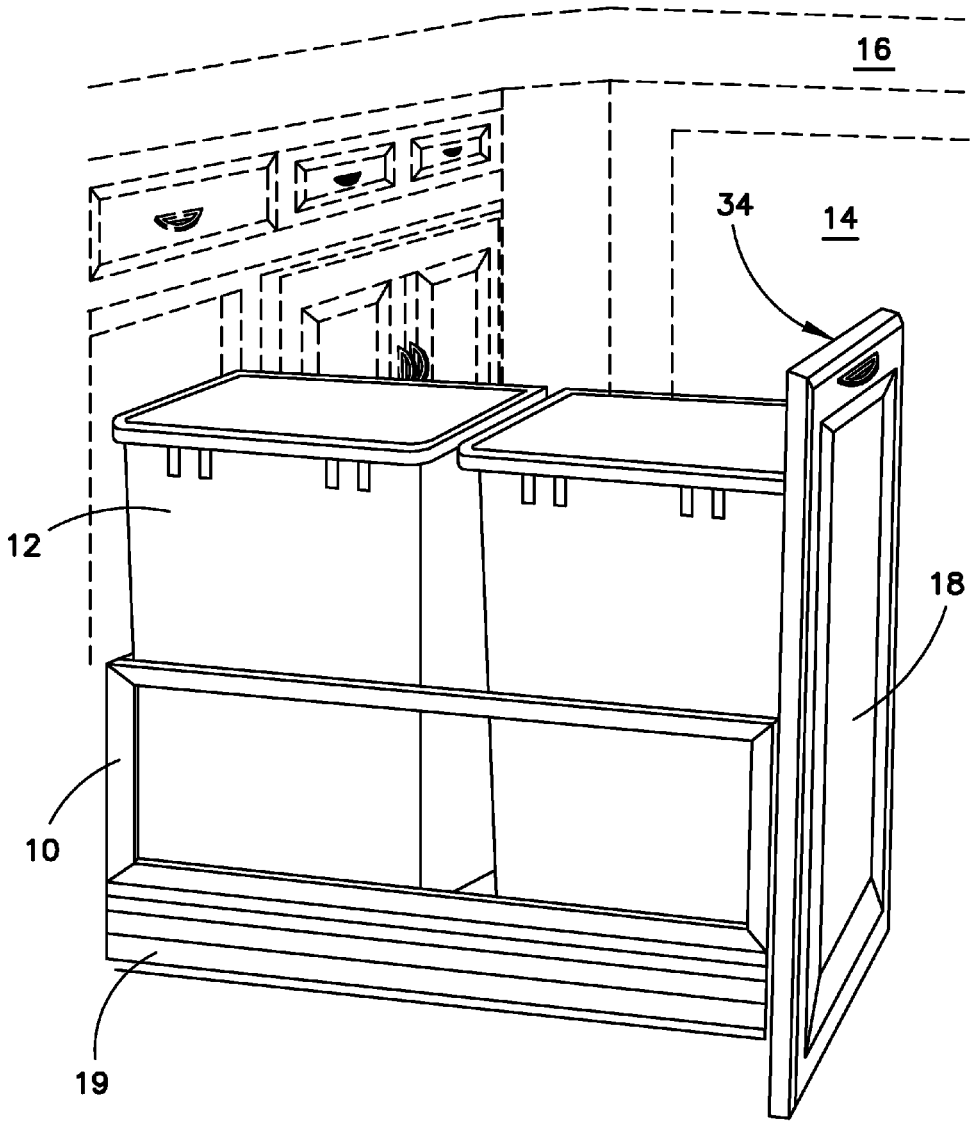
FIG. 1 is a perspective view of a drawer for supporting two waste containers in an under-counter installation including a decorative face panel.
Figure 2:
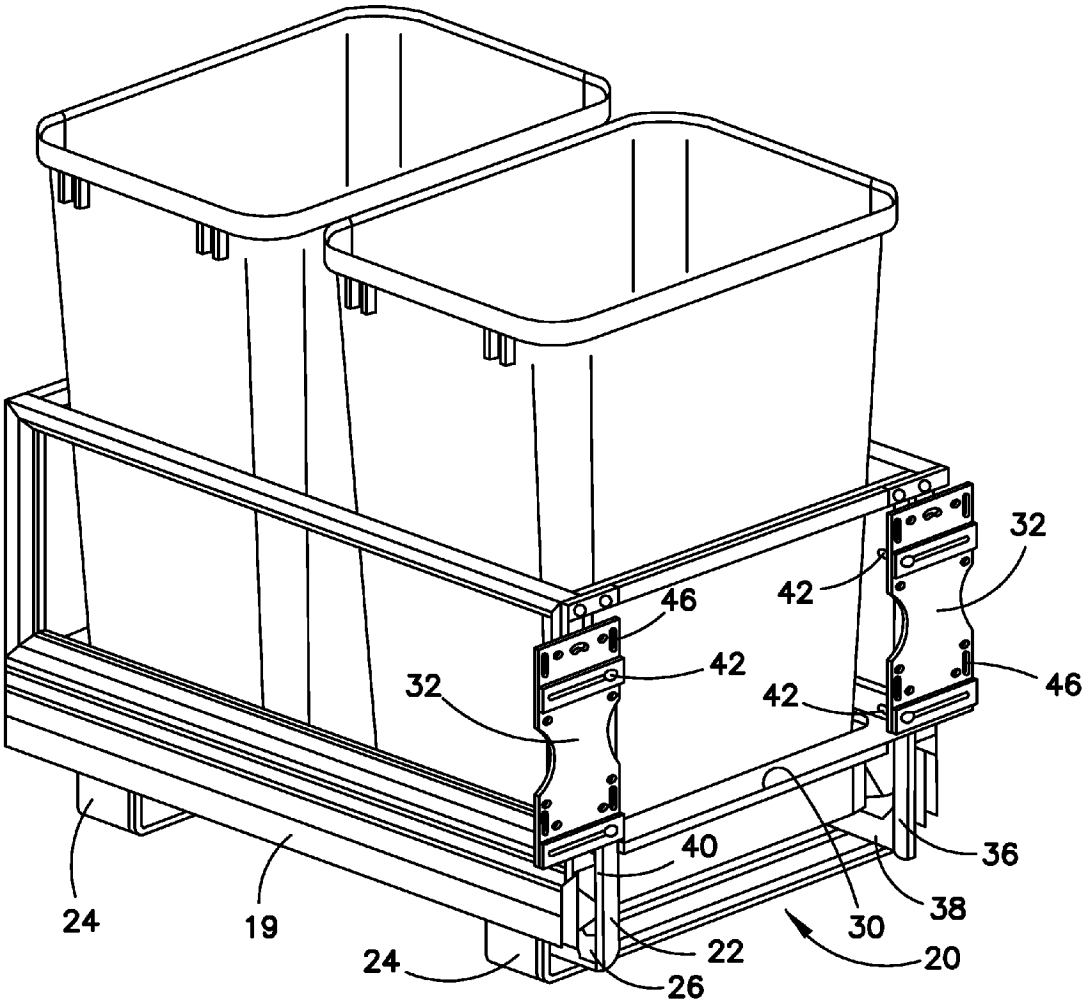
FIG. 2 is a perspective view of a drawer slide system including face panel mounting assemblies.
Figure 5:
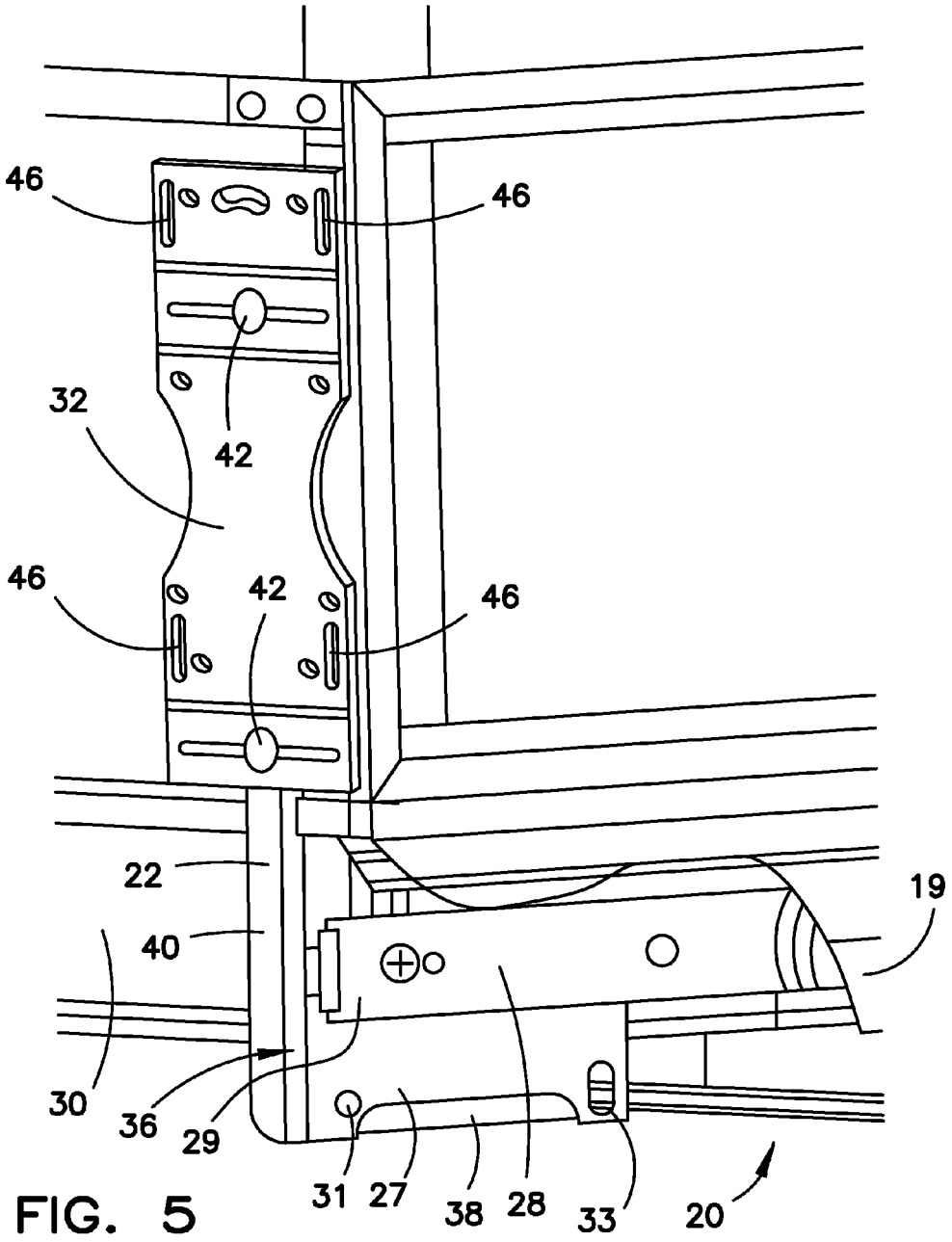
FIG. 5 is a detail perspective view of a portion of the drawer slide system shown in FIG. 2, with the drawer situated in an extended position and with a skirt broken away to reveal a movable drawer slide rail.

FIG. 1 shows a perspective view of a drawer 10 supporting, for example, two waste containers 12 in a cabinet 14 under a counter 16, the drawer 10 including a decorative face panel 18, and a skirt 19 covering the drawer slide rails shown in other Figs. FIGS. 2 and 5 show perspective views of a drawer slide system 20 including face panel mounting assembly 22. The slide system 20 can include base elements 24 adapted to be secured to an interior lower surface of a cabinet 14. Fixed drawer slide rails 26 are secured to the base elements 24. Movable drawer slide rails 28 can be supported for linear movement on the fixed drawer slide rails 26. One or more intermediate rails, not shown, can be used to couple the movable drawer slide rails 28 to the fixed drawer slide rails 26 in a conventional known manner. A floor or base pan 30 can be secured to the movable drawer slide rails 28 for linear movement in and out of the cabinet 14. A forward anchor plate 27 can be fixed to the front end 29 of each of the movable drawer slide rails 28, as show in FIG. 5. The forward anchor plate 27 can include a forward opening 31 and a rearward opening 33. The one of the openings 31, 33, and preferably the rearward opening 33, can be vertically elongated to permit a tilting adjustment of the decorative face panel 18 relative to the cabinet 14.

Figure 6:
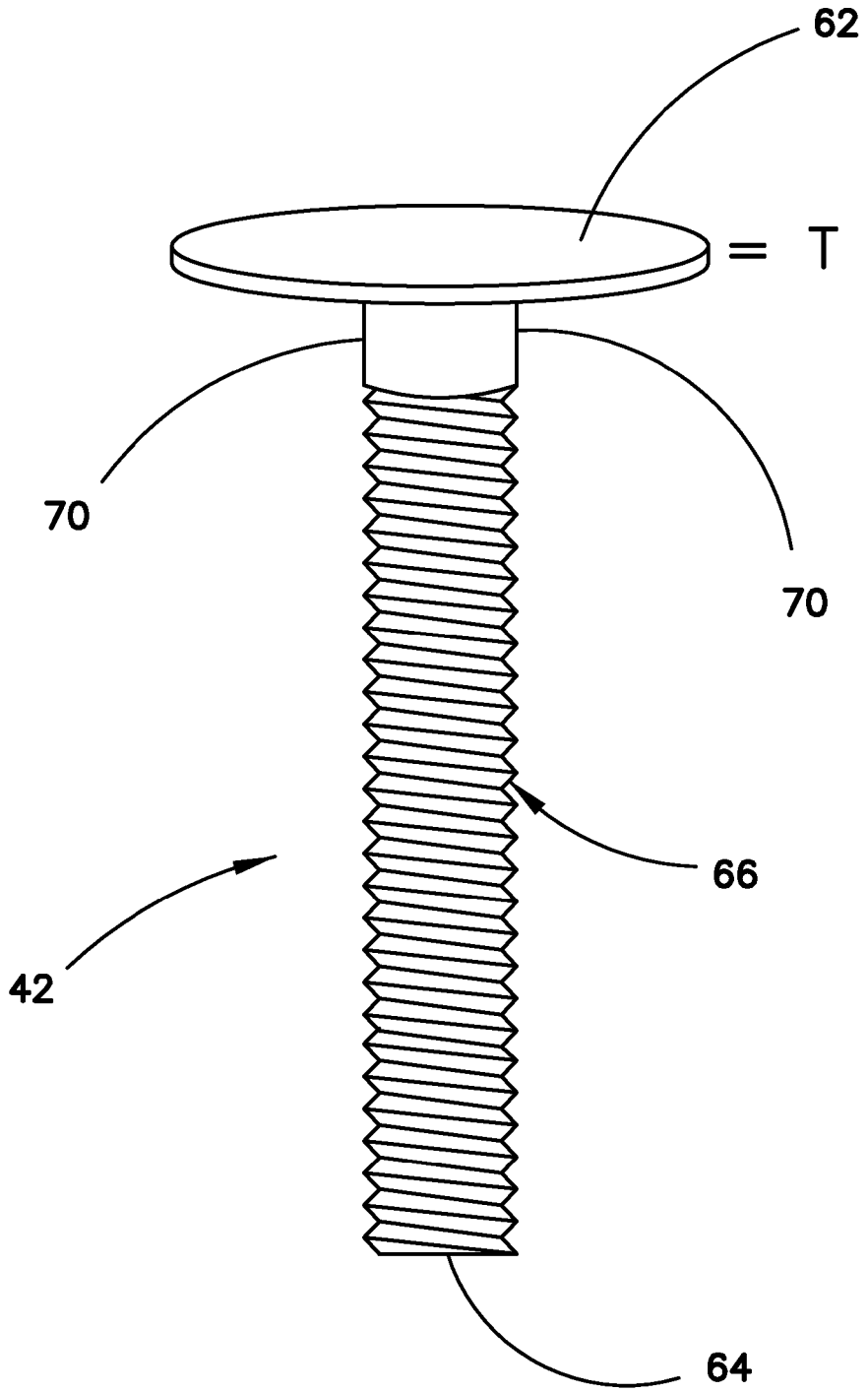
FIG. 6 is a perspective view of a fastener suitable for coupling the plate and bracket second leg.

Each face panel mounting assembly 22, shown in FIGS. 2, 5 and 6, includes a plate 32 adapted to be fixed to a back surface 34 of a drawer face panel 18 by way of fasteners passing through openings 46. The openings 46 can be in the form of vertical slots allowing for adjustment of the vertical position of the face panel 18 relative to the drawer slide system 20 and the cabinet 14. Each face panel mounting assembly 22 also includes an angled bracket 36 having a first leg 38 secured to the movable drawer slide rails 28, and a second leg 40 that extends vertically upward from the first leg 38. Fasteners 42 are provided to pass through the plate 32 and bracket second leg 40 to adjustably secure a drawer face panel 18 to the drawer slide system 20 at a desired position.

Figure 4:
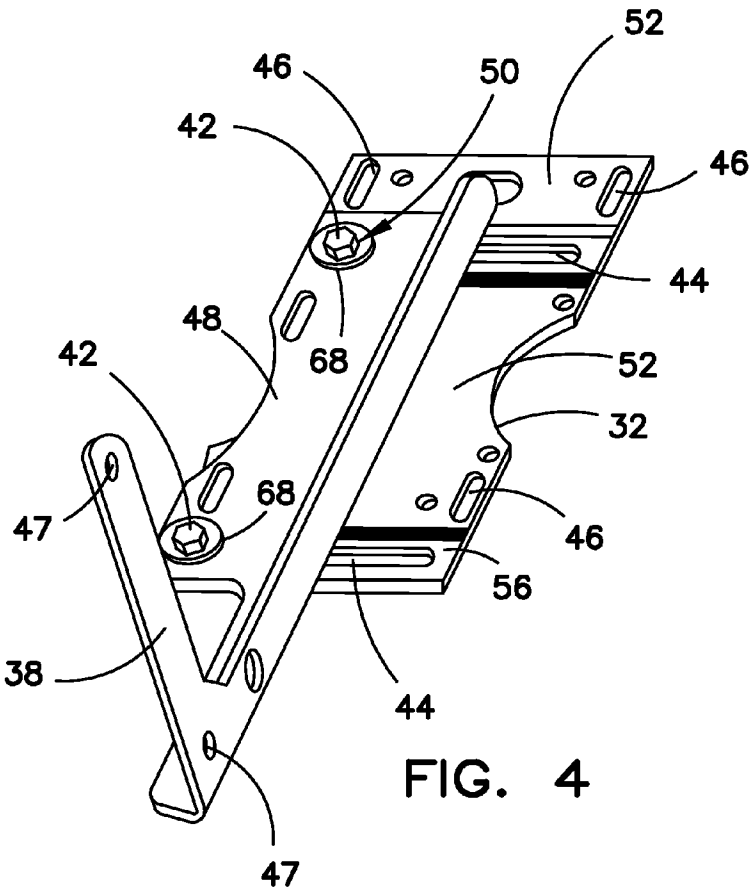
FIG. 4 is a second perspective view of the face panel mounting assembly shown in FIG. 2.
Figure 3:
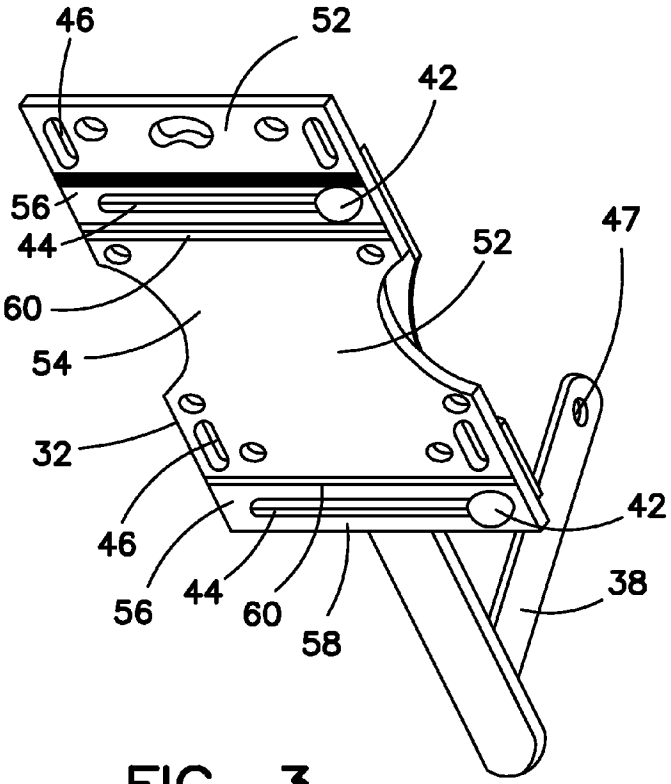
FIG. 3 is a first perspective view of the face panel mounting assembly shown in FIG. 2.

FIGS. 3 and 4 show two perspective views of a face panel mounting assembly 22 shown in FIG. 2. The plate 32 is shown to include a pair of vertically spaced horizontal slots 44 and a plurality of openings 46 adapted to receive fasteners, such as screws, not shown, for securing the plate 32 to a back surface 34 of a drawer face panel 18. The first leg 38 can include a plurality of openings 47 to receive fasteners, such as machine screws, not shown, for securing the first leg 38 to one of the forward anchor plates 27 affixed to a forward end 29 of a movable drawer slide rail 28. In a preferred embodiment, the fastener passing through opening 31 in the anchor plate 27 and into one of the openings 47 defines a pivot point for the angled bracket 36, while the fastener passing through the vertically elongated opening 33 in the anchor plate 27 defines the range of possible movement of the angled bracket 36 about the pivot point. The second leg 40 can include a laterally extending flange 48. The flange 48 can include a pair of openings 50 spaced apart by a distance D equal to the spacing of the vertically spaced horizontal slots 44. The fasteners 42 can pass through the pair of openings 50 in the flange 48 of the angled bracket second leg 40 and through the vertically spaced horizontal slots 44 of the plate 32 to horizontally adjustably secure a drawer face panel 18 to the drawer slide system 20 at a desired position.

As shown in FIGS. 3 and 4, the plate 32 can be formed to include first portions 52 including a planar surface 54 adapted to abut the back surface 34 of a drawer face panel 18, and second portions 56 having a surface 58 recessed from the first portion planar surface 54, the first and second portions being joined to each other by steps 60. The vertically spaced horizontal slots 44 can be confined to the second portions 56 of the plate having the recessed surfaces 58. The vertically elongated openings 46 can be confined to the first portions 52 of the plate 32.

A particularly suitable fastener 42 is shown in FIG. 6 to include a head 62 and a stem portion 64 extending perpendicularly from the head 62. The stem portion 64 is shown to include a threaded portion 66 for engaging a nut 68 as shown in FIG. 4. The stem portion 64 is shown to also include parallel surfaces 70 that are preferably spaced from each other by a distance approximating the width of each of the vertically spaced horizontal slots 44. A fastener 42 of this nature resists turning in the slot 44 so that a nut 68 can be applied to the threaded portion 66 of the stem 64 without holding or restraining the head 62. The head 62 preferably has a thickness T that is less than or equal to the depth of the steps 60 at the edges of recessed surfaces 58 so that the head 62 of fasteners 44 need not contact the adjacent back surface 34 of the drawer face panel 18 when the plate 32 is attached to the face panel back surface 34. The fasteners 42 are commercially available in various sizes and are commonly referred to as elevator bolts.

Figure 7:
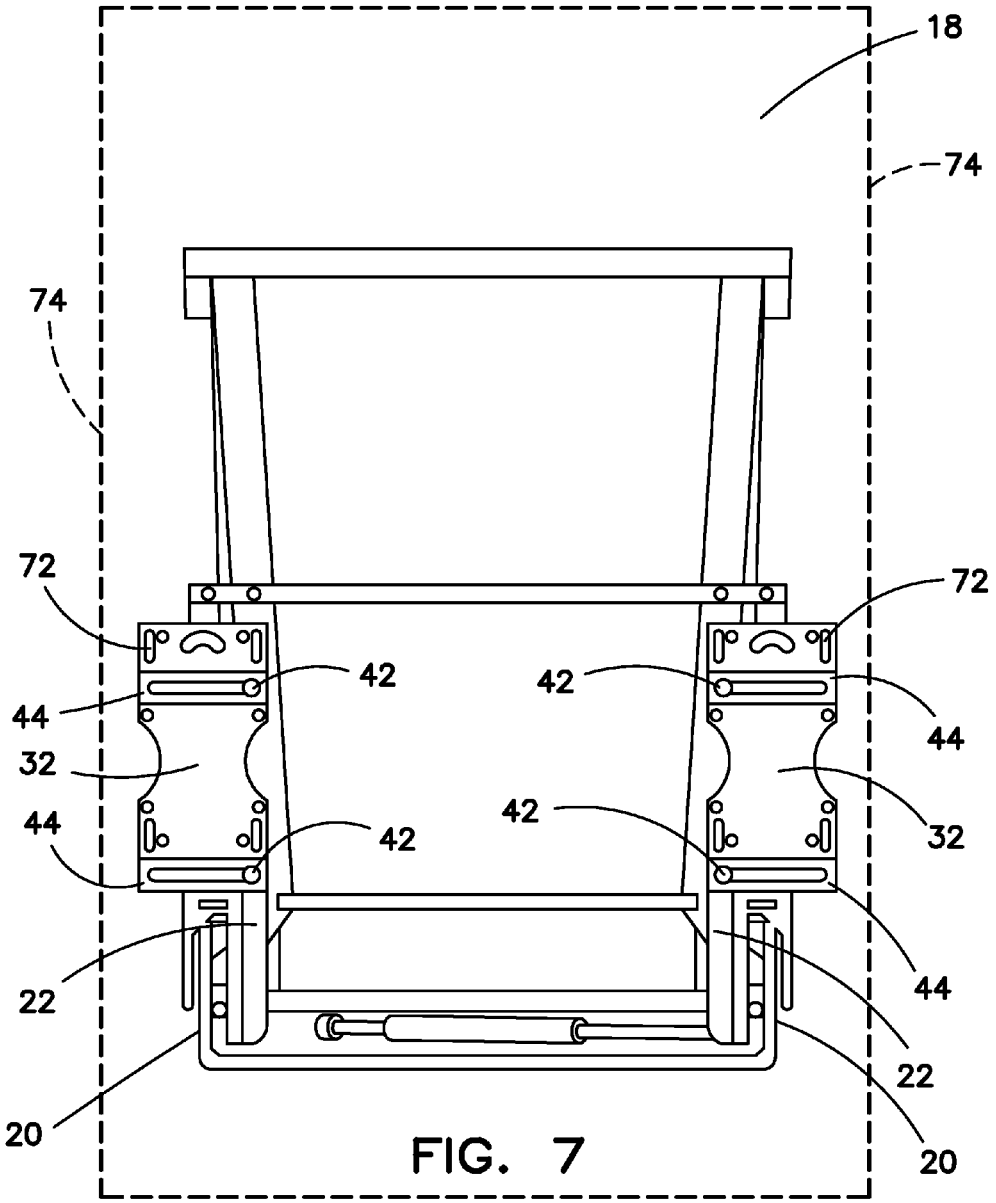
FIG. 7 is a front elevation view of the drawer slide system including face panel mounting assembly and a face panel outlined in phantom.

FIG. 7 shows a front elevation view of a preferred installation of the drawer slide system 20 including face panel mounting assemblies 22 and a face panel 18 outlined in phantom. The plates 32 can include an outside vertical edge 72. When the plates 32 are fixed to the drawer face panel 18, the outside vertical edges 72 can be aligned with lateral outside edges 74 of the drawer face panel 18. While FIG. 6 shows the fasteners 42 to all be at the inside extreme limits of the vertically spaced horizontal slots 44, such positioning is representative of an extreme condition and not a usual installation. A more typical installation might position the fasteners 42 in a central position as shown in FIG. 5.

In an installation of a face panel 18 using the mounting assembly 22, the first legs 38 of a pair of angled brackets 36 are secured to the forward anchor plates 27 affixed to the movable slide rails 28 of a drawer 10. Fasteners 42 are inserted into the vertically spaced horizontal slots 44 in a pair of plates 32. The plates 32, including the fasteners 42, are then adjustably secured at a desired position on the back surface 34 of the decorative face panel 18 so that the fasteners 42 project rearwardly from the plates 32 by means of fasteners passing through the vertical slots 46. The decorative face panel 18 is then coupled to the angled brackets 36 by inserting the rearwardly projecting fasteners 42 into openings 50 in the vertically projecting second leg 40 of angled bracket 36, and secured in a desired position by tightening nuts 68 onto the threaded portions 66 of fasteners 42. The base elements 24 of the slide system 20 can then be suitably positioned and secured within an opening in a cabinet 14. The tilt angle and the horizontal position of the decorative face panel 18 can then be adjusted and secured.

Other variations in dimension will become apparent to those skilled in the art that are still within the scope of the invention as defined in the following claims. The foregoing detailed description should be regarded as merely illustrative rather than limiting, and the following claims, including all equivalents, are intended to define the spirit and scope of this invention.

The invention claimed is:

1. A face panel mounting assembly to provide adjustable mounting of a drawer face panel to a drawer slide mechanism comprising:

a plate adapted to be fixed to a back surface of a drawer face panel, the plate including a pair of vertically spaced horizontal slots and a plurality of openings adapted to receive fasteners for securing the plate to a back surface of a drawer face panel;

an angled bracket having a first leg and a second leg, the first leg including a plurality of openings to receive fasteners for securing the first leg to a drawer slide mechanism, the second leg including a laterally extending flange, the flange including a pair of openings spaced apart by a distance equal to the spacing of the vertically spaced horizontal slots; and fasteners passing through the pair of openings in the flange of the angled bracket second leg and through the vertically spaced horizontal slots of the plate to adjustably secure the drawer face panel to the drawer slide mechanism at a desired position.

2. The face panel mounting assembly of claim 1, wherein the plate includes a first portion including a planar surface adapted to abut the back surface of the drawer face panel, and a second portion having a surface recessed from the first portion planar surface, the first and second portions being joined to each other by steps.

3. The face panel mounting assembly of claim 2, wherein the vertically spaced horizontal slots are confined to the second portion of the plate.

4. The face panel mounting assembly of claim 2, wherein the fasteners include a head having a selected thickness, and wherein the surface of the second portion of the plate is recessed from the first portion of the plate by a distance that at least matches the selected thickness of the head of the fasteners.

5. The face panel mounting assembly of claim 2, wherein the fasteners include a head and a stem portion extending perpendicularly from the head, the stem portion including a threaded portion for engaging a nut, and the head portion including a pair parallel surfaces spaced from each other by a distance approximating the width between the steps defining the second portion.

6. The face panel mounting assembly of claim 1, wherein the fasteners include a head and a stem portion extending perpendicularly from the head, the stem portion including a threaded portion for engaging a nut, and the stem portion including a pair parallel surfaces spaced from each other by a distance approximating the width of each of the vertically spaced horizontal slots.

7. A combination of a drawer slide mechanism having a first portion adapted to be fixed within a cabinet and a second portion adapted to be fixed to the base of a drawer, and a face panel mounting assembly fixed to the second portion of the drawer slide mechanism to provide adjustable mounting of a drawer face panel to the drawer slide mechanism comprising:

a pair of angled brackets, each angled bracket having a first leg and a second leg, the first leg including a plurality of openings receiving fasteners securing the first leg to the drawer slide second portion, the second leg including a laterally extending flange, the flange including a pair of vertically paced apart openings by a first selected distance;

a pair of plates adapted to be fixed to a back surface of a drawer face panel, each plate being situated contiguous to one of the angled brackets, each plate including a pair of vertically spaced horizontal slots, the slots being spaced apart equal to the spacing of the vertically spaced horizontal slots, and a plurality of openings adapted to receive fasteners for securing the plate to a back surface of a drawer face panel;

fasteners passing through the pair of openings in the flange of each angled bracket second leg and through the vertically spaced horizontal slots of each contiguous plate to adjustably secure the drawer face panel to the drawer slide mechanism at a desired position.

8. The combination of claim 7, wherein the fasteners include a head and a stem portion extending perpendicularly from the head, the stem portion including a threaded portion for engaging a nut, and the stem portion including a pair parallel surfaces spaced from each other by a distance approximating the width of the vertically spaced horizontal slots.

9. The combination of claim 7, wherein each plate includes a first portion including a planar surface adapted to abut the back surface of the drawer face panel, and a second portion having a surface recessed from the first portion planar surface, the first and second portions being joined to each other by steps, and wherein the vertically spaced horizontal slots are confined to the second portions of each plate.

10. The combination of claim 9, wherein the fasteners include a head having a selected thickness, and wherein the surface of the second portion of each plate is recessed from the first portion of said plate by a distance that is at least as great as the selected thickness of the head of the fasteners.

11. The combination of claim 7, wherein each of the pair of plates includes an outside edge, the pair of plates being fixed to the drawer face panel so that the outside edges of the pair of plates are aligned with lateral outside edges of the drawer face panel.

12. The combination of claim 7, wherein the second portion of the drawer slide mechanism further comprises a forward anchor plate fixed to the front end of each movable drawer slide rail of the drawer slide mechanism, the forward anchor plate including an opening defining a pivot axis for tilt movement of the drawer face panel and an opening defining a range of movement of the drawer face panel about the pivot axis.

13. The combination of claim 12, wherein the opening defining the pivot axis is positioned in front of the opening defining a range of movement of the drawer face panel about the pivot axis.

14. A method of securing a decorative face panel to a drawer including movable slide rails comprising:

attaching a first leg of each of a pair of angled brackets to the movable slide rails of the drawer so that a second leg of each angled bracket projects vertically adjacent a front end of each movable slide rail;

inserting a fastener into each slot of a pair of plates;

fixing the plates to a back surface of the decorative face panel so that the fasteners project rearwardly from the plates;

positioning the decorative face panel so that the rearwardly projecting fasteners are inserted into openings in the vertically projecting second legs of the pair of angled brackets; and coupling nuts to the fasteners to secure the fasteners at a desired position.

15. The method of claim 14, wherein the attaching step comprises inserting screw fasteners through openings in the first leg of each angled bracket and engaging the screw fasteners into openings in the movable slide rails.

16. The method of claim 14, wherein the fixing step comprises positioning the plates on the back surface of the decorative face panel so that an outside edge of each plate is aligned with an outside edge of the decorative face panel.

17. The method of claim 14, wherein the coupling step comprises horizontally adjusting the decorative face panel to a desired position and tightening the nuts to fix the position of the decorative face panel relative to the drawer.

18. The method of claim 14, wherein the attaching step comprises afixing a forward anchor plate to the front end of each movable drawer slide rail of the drawer slide mechanism, the forward anchor plate including an opening defining a pivot axis for tilting movement of the drawer face panel and an opening defining a range of movement of the drawer face panel about the pivot axis.

19. The method of claim 18, further comprising adjusting the tilt of drawer face panel to a desired angle and securing the first leg of each of a pair of angled brackets to the forward anchor plates.

20. The method of claim 14, further comprising suitably positioning base elements of the slide system within an opening in a cabinet, and securing the base elements to the cabinet.

* * * * *

UNITED STATES PATENT AND TRADEMARK OFFICE

CERTIFICATE OF CORRECTION

PATENT NO. : 8,939,526 B1
APPLICATION NO. : 14/141854
DATED : January 27, 2015
INVENTOR(S) : Paul F. Chambers, Kevin M. Ward, Jr. and David P. Noe It is certified that error appears in the above-identified patent and that said Letters Patent is hereby corrected as shown below:

On the Title Page

Under (74) Attorney, Agent, or Firm, replace "Gilons" with "Gilson"

Signed and Sealed this
Fourteenth Day of July, 2015

Michelle K. Lee

Michelle K. Lee
*Director of the United States Patent and Trademark Office*